US005287163A

United States Patent [19]

Miyashiro et al.

[11] Patent Number: 5,287,163

[45] Date of Patent: Feb. 15, 1994

[54] OVERLAID IMAGE FORMING APPARATUS WITH COORDINATED TRANSFER BIAS AND ATTRACTION BIAS VOLTAGE SOURCES

[75] Inventors: Toshiaki Miyashiro, Machida; Shinkichi Takahashi, Yokohama; Tatsuya Kobayashi, Tokyo, all of Japan

[73] Assignee: Canon Kabushiki Kaisha, Tokyo, Japan

[21] Appl. No.: 968,260

[22] Filed: Oct. 29, 1992

Related U.S. Application Data

[63] Continuation of Ser. No. 832,311, Feb. 7, 1992, abandoned.

[30] Foreign Application Priority Data

Feb. 8, 1991 [JP] Japan ..... 3-039201

[51] Int. Cl.[5] ..... G03G 15/01

[52] U.S. Cl. ..... 355/326 R; 355/208; 355/271; 355/274

[58] Field of Search ..... 355/271, 208, 273-276, 355/326, 328, 327

[56] References Cited

U.S. PATENT DOCUMENTS

| | | | |
|---|---|---|---|
| 3,976,370 | 8/1976 | Goel et al. | 355/271 X |
| 4,415,256 | 11/1983 | Inoue et al. | 355/274 |
| 4,674,860 | 6/1987 | Tokunaga et al. | 355/274 |
| 4,888,621 | 12/1989 | Ohno | 355/326 |
| 4,935,776 | 6/1990 | Fukui | 355/274 X |
| 5,083,167 | 1/1992 | Fukushima et al. | 355/274 |
| 5,084,736 | 1/1992 | Suzuki et al. | 355/271 |
| 5,086,318 | 2/1992 | Takeda et al. | 355/271 |

*Primary Examiner*—R. L. Moses
*Assistant Examiner*—William J. Royer
*Attorney, Agent, or Firm*—Fitzpatrick, Cella, Harper & Scinto

[57] ABSTRACT

A superposed image forming apparatus wherein toner images are superposedly transferred onto a transfer material includes an image bearing member; a device for forming a toner image on the image bearing member; a transfer material carrying member, disposed opposed to the image bearing member, for carrying a transfer material in synchronism with the toner image on the image bearing member; a transfer material supplying device for supplying the transfer material to the transfer material carrying member; a transfer bias voltage source for applying to the transfer material carrying member a bias voltage for image transfer from the image bearing member to the transfer material; an attraction member for urging the transfer material to the transfer material carrying member to hold the transfer material on the transfer material carrying member; an attraction bias voltage source for applying a bias voltage to the attraction member; the bias voltage applied to the attraction member is changed in association with on-and-off of the bias voltage application to the transfer material carrying member so as to maintain a constant surface potential of the transfer material carrying member.

42 Claims, 11 Drawing Sheets

(+)
TRANS BIAS(Vtr)
0
t
TIME
T
(-)

(+)
ATT BIAS(Vabh)
0
TIME
T
(-)

SURF POT OF SHEET ON CARRYING MEMBER JUST BEFORE TRANS ST (V)
(+)
VA
VB
0
VA-B
TIME
T
LEADING
TRAILING
(-)

OVERLAID IMAGE FORMING APPARATUS WITH COORDINATED TRANSFER BIAS AND ATTRACTION BIAS VOLTAGE SOURCES

This application is a continuation of application Ser. No. 07/832,311 filed Feb. 7, 1992, now abandoned.

FIELD OF THE INVENTION AND RELATED ART

The present invention relates to an image forming apparatus for forming a superposed or overlaid images, in which visualized images are formed on an image bearing member through an electrophotographic process or an electrostatic recording process are superposedly transferred onto a transfer material carried on a movable transfer material carrying member.

As for such a color image forming apparatus, an electrophotographic apparatus shown in FIG. 6 may be used. In this apparatus, the image bearing member in the form of an electrophotographic photosensitive drum 4 is uniformly charged by a primary charger 14 in the form of a roller or corona charger. The image bearing member is exposed to image light 16 in accordance with first color image from an exposure device comprising a light emitting element 13 such as a laser or LED elements, so that an electrostatic latent image for the first color component is formed. The latent image is visualized by a developing devices 2*a* containing a yellow (Y) developer, 2*b* containing Magenta (M) developer, 2*c* containing Cyan (C) developer and 2*d* containing Black (Bk) developer, for example.

Referring to FIG. 7A, there is shown a transfer material carrying member 3 in the form of a drum. It comprises ring members 3*d* and a connecting member 3*c*. They constitute a drum frame 3*a* with a cut-away portion in the cylindrical periphery thereof. The cut-away portion is covered with a stretched flexible sheet (transfer material carrying sheet 3*b*) made of dielectric material such as polyethylene terephthalate (PET), polyvinylidene fluoride (PVdF) or fluorinated ethylene propylene copolymer (PEF). It comprises a gripper 3*c* or the like for holding a leading edge of the transfer material 1 supplied thereto. By rotation of the transfer drum 3 thereafter, the transfer material 1 is wrapped around the surface of the transfer drum surface. At this time, the transfer material 1 is sandwiched between an attraction member 15 such as a grounded attraction roller and a flexible sheet 3*b* constituting the transfer material carrying surface, while the electric charge is applied to the back side of the flexible sheet 3*b* by an attraction charger 7, so that the transfer material 1 is held on the surface of the transfer drum 3 by the electrostatic attraction force. Subsequently, the transfer material is carried by rotation of the transfer drum 3 to an image transfer position where the transfer drum is faced to the photosensitive drum. In the image transfer position, the visualized image is transferred from the photosensitive drum 4 onto the transfer material 1 by a transfer charger 8.

The photosensitive drum 4 is then cleaned by a cleaner 5 so that the residual developer thereon is removed. Then, the photosensitive drum 4 is uniformly charged again by the primary charger 14 and exposed to the image light for the second color component image so that an electrostatic latent image is formed on the photosensitive drum 4. The electrostatic latent image is developed by a developing device 2*b* containing a magenta (M) developer, for example, into a visualized image corresponding to the image signal for the second color component.

The second color visualized image is transferred again by the transfer charger 8 onto the same transfer material 1 on the transfer drum 3 now already having the visualized image for the first color component. The same process is repeated for the third (cyan (C)) color and the fourth color (black (BK)). The third and fourth visualized images are superposedly transferred onto the same transfer material on the transfer drum 3.

The transfer material 1 now having all of the color component visualized images is conveyed by the rotation of the transfer drum 3 to the separation chargers 9 disposed to the inside and the outside of the transfer drum 3. The electrostatic attraction force between the transfer material 1 and the flexible sheet 3*b* is removed by the separation chargers 9. It is separated by separation pawls 11 while being discharged by the separation discharger 10 from the transfer drum 3. The separated transfer material 1 is conveyed along the transfer material passage to the fixing device 6 where the image is fixed thereon.

The transfer drum 3 after the transfer material 1 is separated is cleaned by a transfer drum cleaner (not shown) so that the developer deposited on the surface of the flexible sheet 3*b* is removed. It is further discharged by a pair of sheet discharging chargers 12 sandwiching the sheet 3*b*, so that it is electrically initialized.

In the foregoing description, the transfer material carrying member used for the color image formation through superposing image transfer process, is in the form of a transfer drum having a cut-away portion.

FIG. 7B shows another type of transfer drum 3 which comprises an electrically conductive drum base 3*a* without the cut-away portion 3*e* and a flexible sheet 3*b* of the same material as described for the flexible sheet. It is supplied with a bias voltage. With the use of such a transfer drum, the same superposing image transfer operation as in the transfer drum having the cut-away portion, is possible. In the case of this type of transfer drum 3, the structure inside the transfer drum is simpler than in the case of the transfer drum having the cut-away portion. Therefore, the manufacturing cost can be reduced. In addition, since the flexible sheet 3*b* is backed up by the drum base at its entirety, and therefore, the problem with the transfer drum having the cut-away portion, that is, the deformation or the damage of the sheet can be eased. Therefore, a color image forming apparatus using a conductive drum not having the cut-away portion (solid drum) is considered noteworthy.

Referring to FIG. 8, the image forming operation of a color image forming apparatus using such a transfer drum will be described. In FIG. 8, the same reference numerals as in the color image forming apparatus of FIG. 6 are assigned to the elements having the corresponding structure and functions, and the detailed description thereof are omitted.

The transfer material 1 supplied along the transfer material passage is gripped between the transfer roller 3 and the attraction roller 15 which is movable toward and away from the transfer drum 3. Simultaneously therewith, a transfer bias in the form of a DC voltage for the attraction and the first color image transfer is applied to the drum base 3*a*. The electric charge induced thereby from the attraction roller 15 is effective to attract the transfer material 1 to the transfer drum 3 by the electrostatic attraction force. The amount of the electric charge injected into the transfer material 1 is smaller than the charge amount when the electrostatic capacities of the transfer material 1 and the flexible sheet 3*b* are sufficiently charged by the same bias voltage. This is because when the electric charge is injected into the transfer material 1 by the attraction roller 15, the transfer drum 3 carrying the transfer material 1 is rotating, and therefore, the contact period with the attraction roller 15 is short, and therefore, the injection of the electric charge is not sufficient. Corresponding to the insufficiency of the electric charge injection, the surface potential of the transfer material 1 passing by the attraction roller 15 is closer to the bias voltage applied to the transfer drum 3, and therefore, by selecting the polarity of the bias voltage applied to the transfer drum 3 to promote the transfer of the visualized image from the image bearing member, satisfactory transfer action is achieved if the level of the voltage is properly selected.

The transfer material 1 carried on the transfer drum 3 is conveyed by the rotation of the transfer drum 3 to an image transfer position, where the transfer material 1 receives the first color visualized image from the image bearing member 4. When the second color visualized image is to be transferred, the bias voltage is changed so that the reduction of the surface potential due to the first color visualized image transfer, is compensated. Such correction is carried out for the third color and the fourth color. With such corrections, the visualized images are transferred from the image bearing member 4 onto the transfer material 1 carried on the transfer drum 3.

The transfer material 1 having been subjected to such image transfer operations, is discharged by the separation charger 9, by which the electrostatic attraction force with the transfer drum is removed. It is then separated from the transfer drum 3 while being subjected to the operation of the separation discharging charger 10 for suppressing the separation discharge occurrence. The visualized image now formed on the transfer material 1 is fixed by the fixing device 6 into a permanent image.

The image transfer operation in the color image forming apparatus using the solid drum has been described. The developing operation in the color image forming apparatus is the same as with the color image forming apparatus using the transfer drum having the cut-away portion shown in FIG. 6.

In the color image forming apparatus, the image bearing member 4 is contacted with the transfer drum 3 for carrying the transfer material 1, or is spaced with a small clearance which is equivalent to the thickness of the transfer material 1 used (approximately 30–300 microns). By doing so, the developer constituting the visualized image on the image bearing member 4 is efficiently transferred onto the transfer material 1. However, if a potential difference of several hundreds V–several KV is produced between the image bearing member 4 surface and the transfer drum 3 surface without the developer on the image bearing member 4, electric discharge or the like occurs between the surface of the image bearing member and that of the transfer drum 3, because the clearance therebetween is small if any. If this occurs, the electric charge of the opposite polarity moves to the image bearing member 4 and the transfer drum 3. The movement of the electric charge is active particularly when the transfer bias is applied when the transfer material 1 is not carried on the transfer drum 3. In the case of a reverse development using a negative toner, for example, the positive charge moves significantly to the image bearing member 4 because the polarity of the transfer bias is positive, and therefore, the electric charge due to the uniform negative charge to the image bearing member 4 promotes it. The positive charge moved onto the image bearing member 4 may be removed by the primary charger 14 disposed downstream of the transfer station with respect to the rotational direction of the image bearing member 4, if the amount of the positive charge is small. However, if the amount of the moving electric charge exceeds a predetermined level, it is not possible to remove it even by the increased bias voltage to the primary charger 14 because there is a limit in the mobility relative to the positive charge in the photosensitive layer constituting the surface layer of the image bearing member. The positive charge not moved by the primary charger 14 disturbs the surface potential of the image bearing member 4 after the primary charging, and the positive charge appears as a transfer memory during the next image formation.

Particularly in the case of the solid transfer drum 3, the transfer bias for the first color is also used for the electrostatic attraction of the transfer material 1, and therefore, the transfer bias application timing is the time when the leading edge of the transfer material 1 reaches the attraction point where the attraction roller 15 is faced to the transfer drum 3 at a position upstream of the image transfer position in the rotational direction of the transfer drum 3, while in the case of the transfer drum having the cut-away portion (FIG. 7A), the timing is the time when the leading edge of the transfer material 1 reaches the image transfer position. Therefore, in the case of the solid drum 3 in which the transfer bias is applied to the entire surface of the transfer drum 3, unlike the transfer drum 3 using the drum having the cut-away portion, the potential difference of several K is produced between the image bearing member and the transfer drum 3 surface at a portion Lpho on the image bearing member 4 corresponding to the transfer drum 3 portion Ltr in FIG. 3. Therefore, the above-described memory attributable to the movement of the electric charge from the transfer drum to the image bearing member, tens to occur.

SUMMARY OF THE INVENTION

In order to provide a solution to the above problem, it is considered that the attraction roller 15 is not grounded, and an attraction bias voltage source 18 for attraction of the transfer material 1 is provided in addition to the transfer bias voltage source 17, as shown in FIG. 9. By doing so, similarly to the case of the transfer drum 3 having the cut-away portion, the transfer bias is applied at the time immediately before the leading edge of the transfer material 1 reaches the image transfer position. This is effective to solve the problem of the transfer memory attributable to the above-described motion of the electric charge.

However, as shown in FIG. 10(C), a new problem arises, that is, the surface potential of the transfer material 1 conveyed to the image transfer position is significantly different between the leading edge and the trailing edge portions of the transfer material 1. This is attributable to the fact that the potential of the transfer drum 3 functioning as an opposite electrode of the attraction roller 15 upon the attraction of the transfer material 1 is changed by the application of the transfer bias during the attraction process for the transfer material 1.

FIGS. 10A and 10B show the application timing of the various bias voltages. FIG. 10C shows the change of surface potential of the transfer material at a position immediately before the image transfer position. The time t, a distance l on the periphery of the transfer drum between the transfer material attraction position and the image transfer position, a rotational angular speed of the transfer drum w, a radius r of the transfer drum, are related as follows:

$$l = Lwt.$$

In the foregoing method, the length Lt of the transfer material 1 measured in its conveyance direction is larger than the distance (l) on the periphery of the transfer drum between the attraction point and the image transfer point, and therefore, the transfer material 1 is still subjected to the electrostatic attraction operation adjacent the trailing edge portion in the transfer material attraction position at the time when the leading edge of the transfer material 1 has reached the image transfer position. Thus, when the transfer bias is applied, the potential difference Vtr-abh between the output voltage Vtr of the attraction bias voltage source 18 and the output voltage Vabh of the transfer bias voltage source 17 is different between before and after the transfer bias application by Δvtr-abh. By this, the amount of electric charge Q injected into the transfer material 1 is different at the leading edge of the transfer material than at the trailing edge.

Generally, the polarity of the attraction bias voltage is selected to be the same as the charge of the developer in order to prevent cancellation of attraction charge injected by the attraction step with the electric charge (that of the developer) injected at each of the image transfer operations. In view of this, when the conventional transfer and attraction bias voltage source circuits, the amount of electric charge Q2 injected into the transfer material 1 is larger than the injected charge amount Q1 upon the attraction without the application of the transfer bias by the amount corresponding to ΔVtr-abh, that is, the difference between the transfer bias voltage and the potential difference Vtr-abh between the output terminals of the attraction bias voltage source. In other words, there occurs a surface potential different ΔVa-b corresponding to the difference ΔQ1-2 of the injected charge amount, where Va is a potential of a portion A from the leading edge of the transfer material 1 in a length l therefrom (the same length l measured on the circumference of the transfer drum), and Vb is a surface potential of a portion B downstream from the position of the length l with respect to the conveyance direction. Because of this, the surface potential of the transfer material in the transfer operation for the first color is different at the leading edge of the transfer material 1 than at the trailing edge by approximately several hundreds V-several KV. The difference of the surface potential results in the significant difference in the transfer efficiency at the leading edge and trailing edge of the transfer material 1. Particularly in the case of color image formation, the uniformity in the contrast or the like is more important than in the monochromatic image. The local change in the transfer efficiency disturbs significantly the color balance.

Accordingly, it is a principal object of the present invention to provide an image forming apparatus capable of providing a high quality image, more particularly, a superposed image, in which the occurrence of the transfer memory attributable to the transfer bias voltage application upon the transfer material attraction, which appears more frequently in the case of the solid transfer drum, is suppressed and/or in which the non-uniformity of the transfer efficiency arising when the transfer memory problem is solved, is suppressed.

It is another object of the present invention to provide a high quality color image forming apparatus in which non-uniformity of chromatic toner, if used, is suppressed.

It is a further object of the present invention to provide a full-color image forming apparatus capable of providing a high quality image in which the non-uniformity of the yellow, magenta, cyan toner images, is suppressed.

According to an aspect of the present invention, there is provided a superposed image forming apparatus wherein toner images are superposedly transferred onto a transfer material, comprising: an image bearing member; means for forming a toner image on said image bearing member; a transfer material carrying member, disposed opposed to said image bearing member, for carrying a transfer material in synchronism with the toner image on said image bearing member; transfer material supplying means for supplying the transfer material to said transfer material carrying member; a transfer bias voltage source for applying to said transfer material carrying member a bias voltage for image transfer from said image bearing member to the transfer material; an attraction member for urging the transfer material to said transfer material carrying member to hold the transfer material on said transfer material carrying member; an attraction bias voltage source for applying a bias voltage to said attraction member; the bias voltage applied to the attraction member is changed in association with on-and-off of the bias voltage application to said transfer material carrying member so as to maintain a constant surface potential of said transfer material carrying member.

According to another aspect of the present invention, there is provided a superposed image forming apparatus wherein different toner images are superposedly transferred onto a transfer material, comprising: an image bearing member; means for forming a toner image on said image bearing member; a transfer material carrying member, disposed opposed to said image bearing member, for carrying a transfer material in synchronism with the toner image on said image bearing member; transfer material supplying means for supplying the transfer material to said transfer material carrying member; a transfer bias voltage source for applying to said transfer material carrying member a bias voltage for image transfer from said image bearing member to the transfer material; an attraction member for urging the transfer material to said transfer material carrying member to hold the transfer material on said transfer material carrying member; an attraction bias voltage source for applying a bias voltage to said attraction member; wherein the voltage applied to said transfer material carrying member is changed in association with on-and-off of the voltage application to said attraction member so as to maintain a constant surface potential of said transfer material carrying member.

According to a further aspect of the present invention, there is provided a color image forming apparatus for forming a color image wherein different color toner images are superposedly transferred onto a transfer material, comprising: an image bearing member; means for forming a toner image on said image bearing member; a transfer material carrying member, disposed opposed to said image bearing member, for carrying a transfer material in synchronism with the toner image on said image bearing member; transfer material supplying means for supplying the transfer material to said transfer material carrying member; a transfer bias voltage source for applying to said transfer material carrying member a bias voltage for image transfer from said image bearing member to the transfer material; an attraction member for urging the transfer material to said transfer material carrying member to hold the transfer material on said transfer material carrying member; a attraction bias voltage source for applying a bias voltage to said attraction member; wherein said transfer material carrying member includes a conductive base member and an electrostatic attraction surface layer; wherein a polarity of the voltage applied to said attraction member is changed to the same polarity as that of the voltage applied to said transfer material carrying member when the transfer bias voltage is applied to said transfer material carrying member so as to maintain substantially constant surface potential of said transfer material carrying member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 10A, 10B and 10C show an output of a transfer bias voltage source, an output of an attraction bias voltage source and a surface potential of a transfer material supplied to an image transfer position in a.

DESCRIPTION OF THE PREFERRED EMBODIMENTS

Referring to the accompanying drawings, preferred embodiments of color image forming apparatus according to the present invention will be described.

Figure 1:
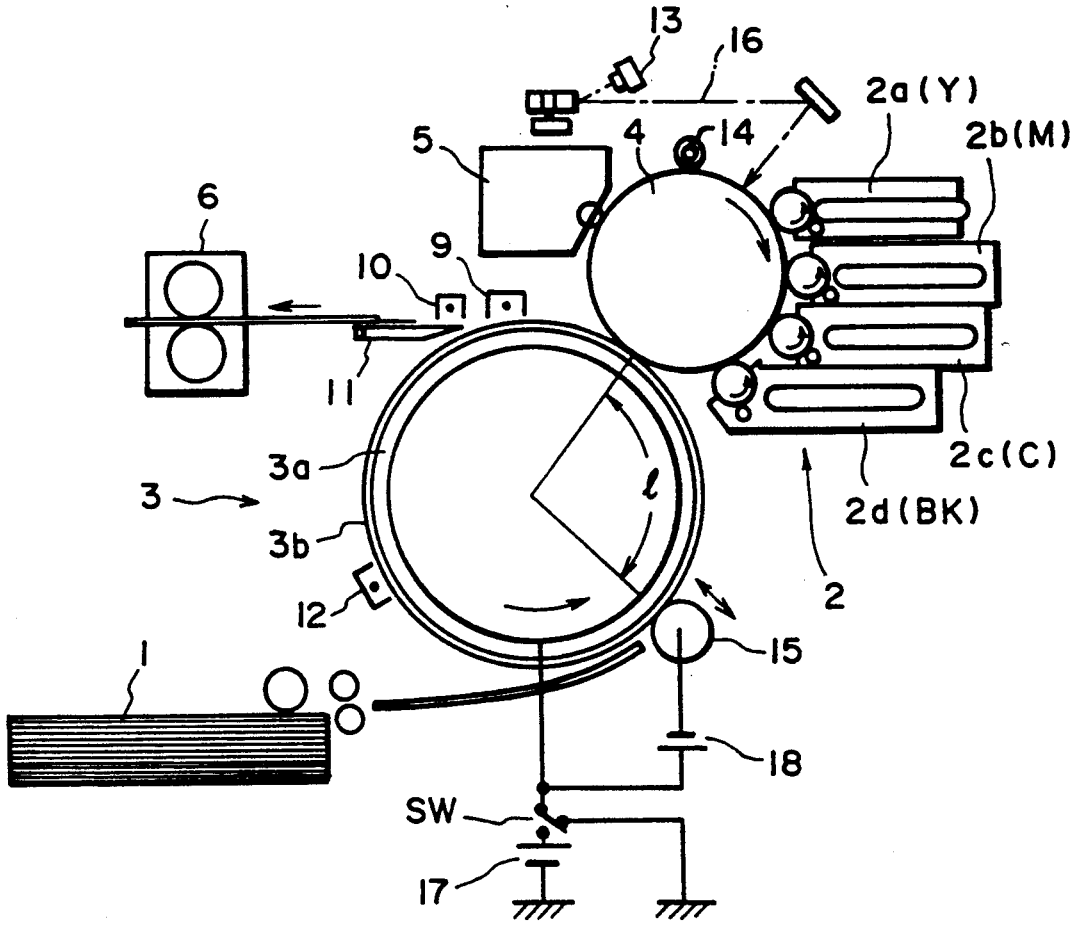
FIG. 1 is a sectional view of a color image forming apparatus according to an embodiment of the present invention.
Figure 7A:
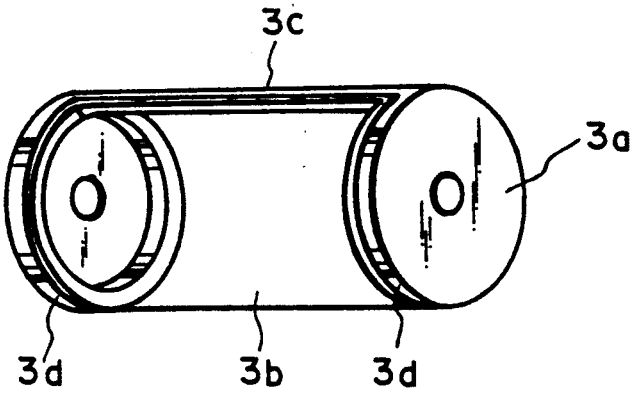
FIGS. 7A and 7B are perspective views of transfer material carrying members.
Figure 7B:
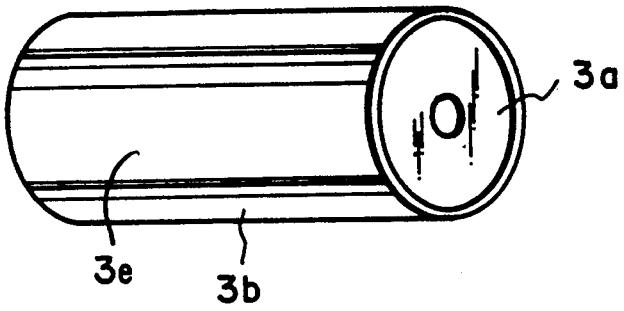
Figure 8:
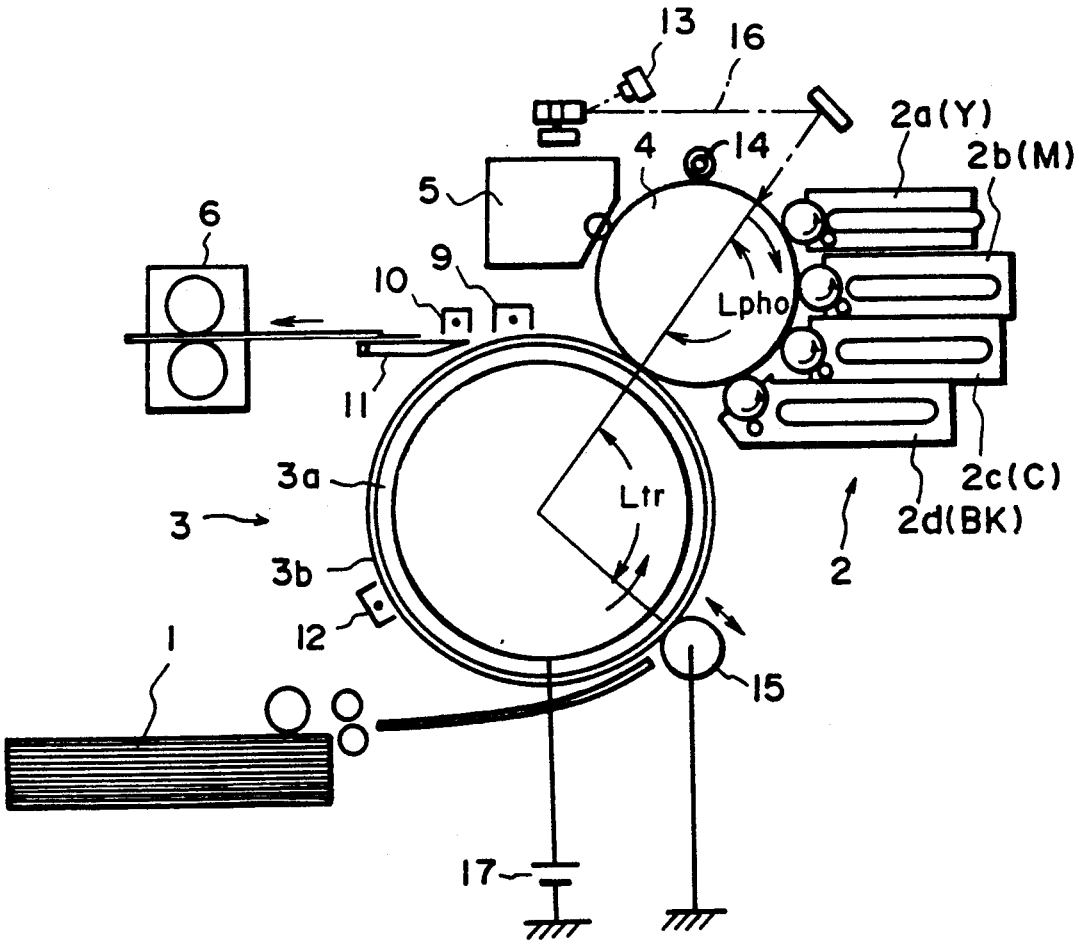
FIG. 8 is a sectional view of a color image forming apparatus.
Figure 9:
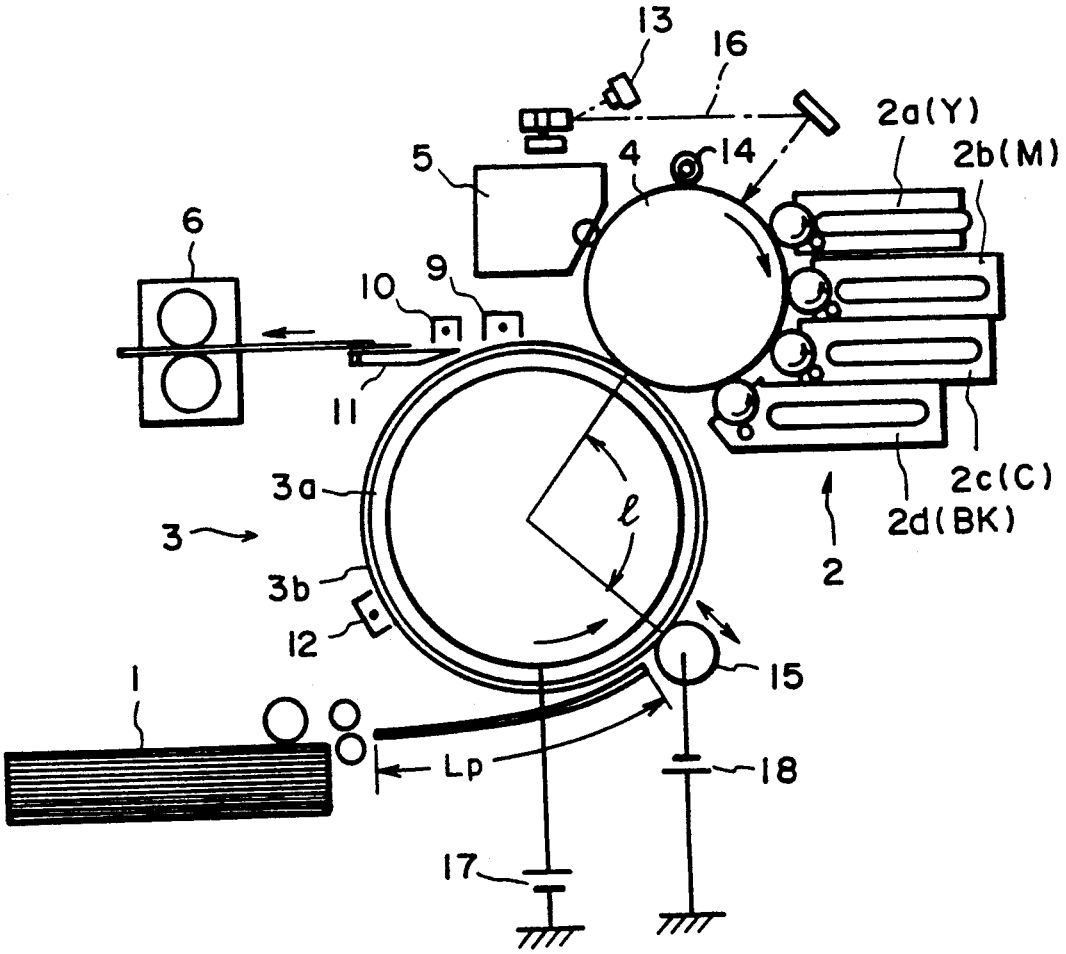
FIG. 9 is a sectional view of a color image forming apparatus.

Referring first to FIG. 1, there is shown an electrophotographic color image forming apparatus according to an embodiment of the present invention. In this FIGURE, the same reference numerals as in FIGS. 8 and 9 are assigned to the elements having the corresponding functions, and the detailed description of these elements are omitted for simplicity. In this embodiment, the transfer material carrying member 3 is in the form of a solid drum having the same structure as described in conjunction with FIG. 7B. More particularly, the transfer drum 3 comprises a conductive drum base 3*a* not having the cut-away portion and a dielectric flexible sheet 3*b* thereon. As desired, the flexible sheet 3*b* may have a conductive material coating functioning as an electrode, on the surface closure to the drum base 3*a*.

In this embodiment, the attraction bias voltage source for applying an attraction bias voltage to an attraction member 15 which may be in the form of an attraction roller, for example, has a reference electrode which is not grounded, unlike the conventional attraction bias voltage source. Rather, it is electrically connected to an output terminal of the transfer bias voltage source 17. The color image formation process in this embodiment will be described.

The transfer material 1 is supplied along a transfer material passage is supplied to a transfer material attracting position where the attraction roller 15 movable toward and away from the transfer material carrying member 3 is contacted to the transfer material carrying member 3. There, the leading edge of the transfer material is gripped by the nip formed between the transfer drum 3 and the attraction roller 15 supplied with the attraction bias voltage, and the transfer material 1 is electrostatically attracted on the transfer drum 3 surface. At this time, the transfer bias is not yet been applied to the transfer drum 3. Rather, the transfer drum 3 is grounded through a circuit in a transfer bias voltage source 17.

The transfer material 1 electrostatically attracted on the transfer drum 3 is carried by the rotation of the transfer drum 3 to the image transfer position, where the surface potential thereof is increased up to a voltage (approximately 1 KV) for proper first color image transfer, by the transfer bias for the first color which is applied thereto immediately before the image transfer position. The application of the transfer bias voltage electrostatically transfer the visualized image from the image bearing member 4 onto the transfer material 1. The attraction bias voltage source 18 which applies the attraction bias to the attraction roller 15 has the reference voltage which is the output voltage of the transfer bias voltage source 17, by a switch SW. Therefore, it is necessarily changes the output of the attraction bias voltage toward the opposite polarity side relative to the ground level.

By doing so, the potential difference Vtr-abh between the output terminals of the transfer bias voltage source 17 and the attraction bias voltage source 18 does not change by the application of the transfer bias, and therefore, the injection electric charge amount Q from the attraction roller to the transfer material, which is attributable to the non-uniformity of the transfer, can be made constant. Therefore, the surface potential of the transfer material 1 entering the image transfer position may be maintained constant, thus preventing improper image transfer due to the variation in the surface potential of the transfer material.

Thereafter, the transfer material 1, as described with the conventional apparatus, receives the second color, the third color visualized images from the image bearing member 4, which are superposedly transferred onto the same transfer material 1. Subsequently, it is separated from the transfer drum 3 by separation charge 9, and is fixed in the fixing device 6 into a permanent image. The transfer bias voltages for the second and third colors are equivalent to or higher than the transfer bias voltage for the first color, in order to provide proper image transfer in the second color and third color image transfer operations.

Figure 2A:
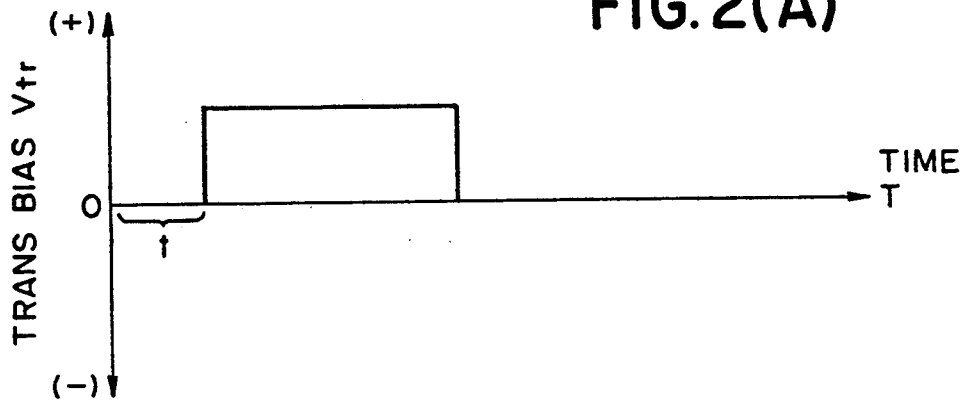
FIGS. 2A, 2B and 2C show an output of the transfer bias voltage source and an output of an attraction bias voltage source and a surface potential of the transfer material supplied to the image transfer position.
Figure 2B:
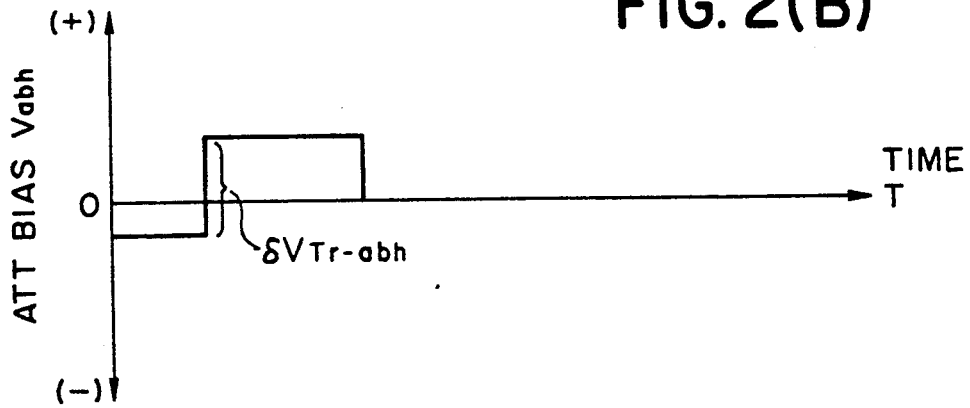
Figure 2C:
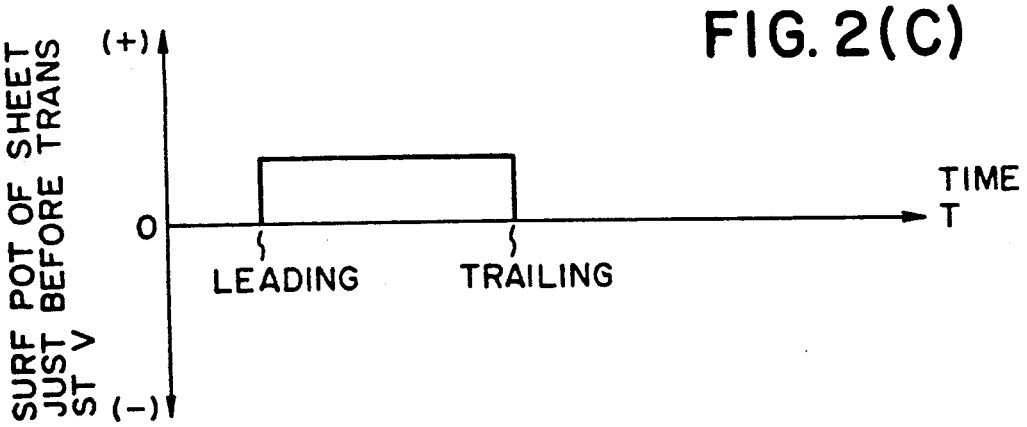
Figure 10A:
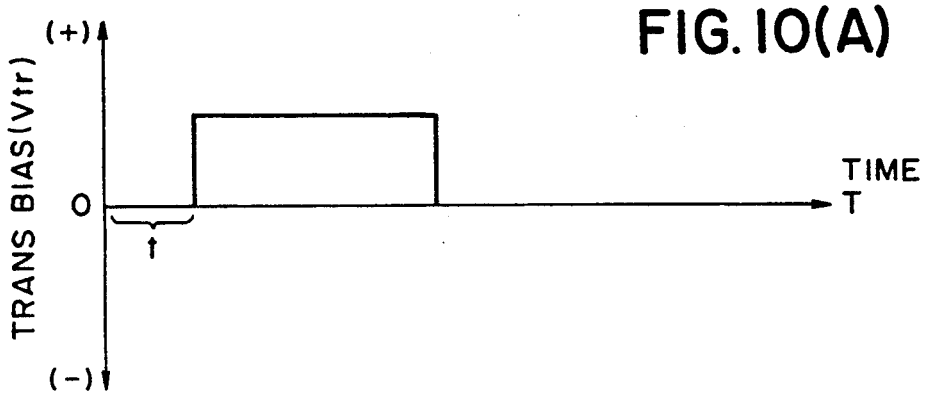
Figure 10B:
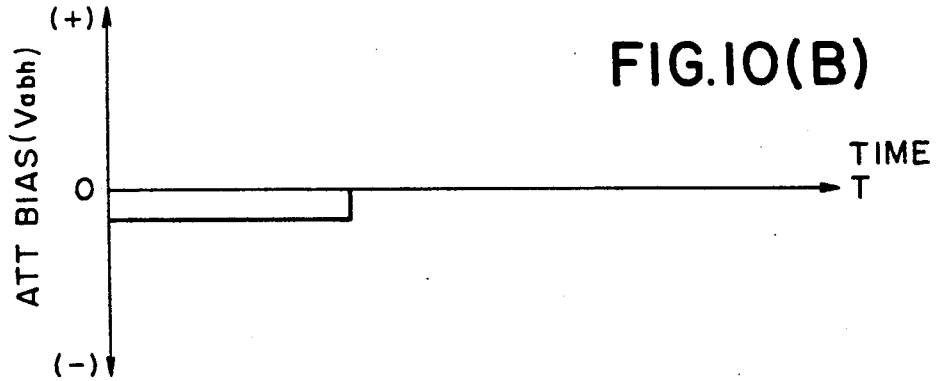
Figure 10C:
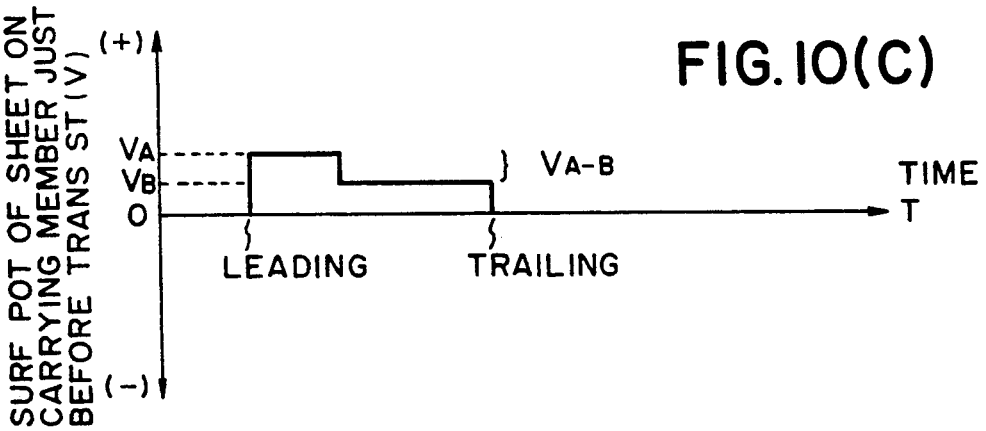

FIG. 2 shows the output voltage changes of the transfer and attraction bias voltage source 17 and 18 in the above-described image formation process, and the change in the surface potential of the transfer material 1 immediately before the image transfer position. Similarly to FIG. 10 having been described, (A) and (B) show application timing of the bias voltages, and (C) shows the change in the surface potential of the transfer material immediately before the transfer position.

Figure 3:
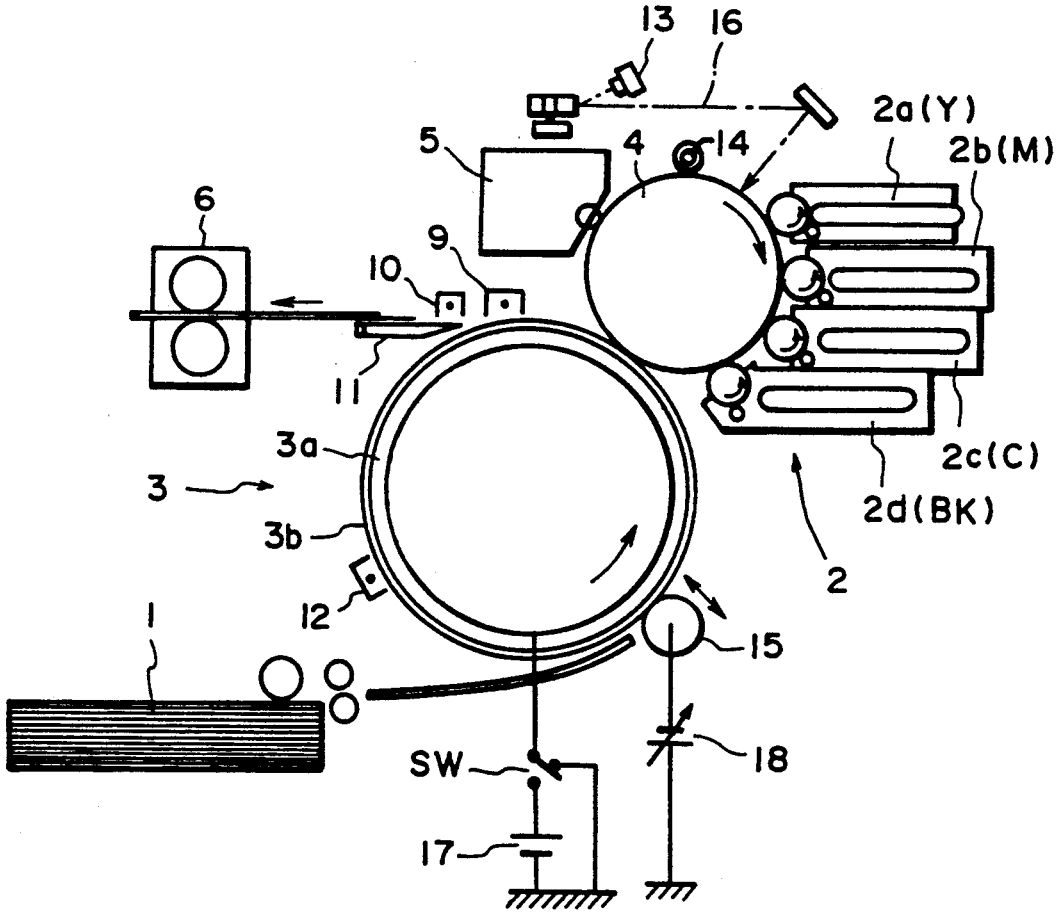
FIG. 3 is a sectional view of a color image forming apparatus according to another embodiment of the present invention.

FIG. 3 is a sectional view of a color image forming apparatus according to a second embodiment of the present invention. As contrasted to the above-described embodiment, the attraction bias voltage source 17 is electrically grounded, and a bias voltage source circuit is capable of changing the output voltage of the attraction bias voltage source 18 at predetermined timing in the first color image formation. In this embodiment, when the transfer bias voltage is applied, the attraction bias voltage level is changed by a difference ΔVtr-abh which is the difference in the potential difference between the output terminals of the transfer and attraction bias voltage sources 17 and 18 between before and after the transfer bias voltage application. Thus, similarly to the foregoing embodiment, even when the transfer bias voltage is applied, the output of the attraction bias voltage source 17 is changed so as to maintain a constant potential difference Vtr-abh between the output terminals of the transfer bias voltage source 17 and the attraction bias voltage source 18. Therefore, a constant amount of attraction charge Q1 is always injected into the transfer material 1 by the attraction roller 15. Thus, irrespective of the presence or absence of the transfer bias voltage application at the time of the attracting operation, the surface potential of the transfer material 1 reaching the image transfer position is always constant.

Unlike the foregoing embodiment, this embodiment requires that the attraction bias voltage is changed at the predetermined timing t in the first color image transfer operation. However, since the attraction bias voltage source 18 is grounded, the attraction bias voltage is more stabilized than in the previous embodiment, and the cost of the apparatus is reduced.

The output voltage changes of the transfer and attraction bias voltages in the image forming process are the same as in the foregoing embodiment (FIG. 2). However, the timing t for changing the attraction bias voltage is expressed as follows:

$$t = \text{distance } (l/rw) \qquad (1)$$

where l is a distance between the attraction roller contact point to the image transfer position measured along the circumference of the transfer drum 3, r is a radius of the transfer drum 3 and the rotational angular speed of the transfer drum 3 is w.

Figure 4:
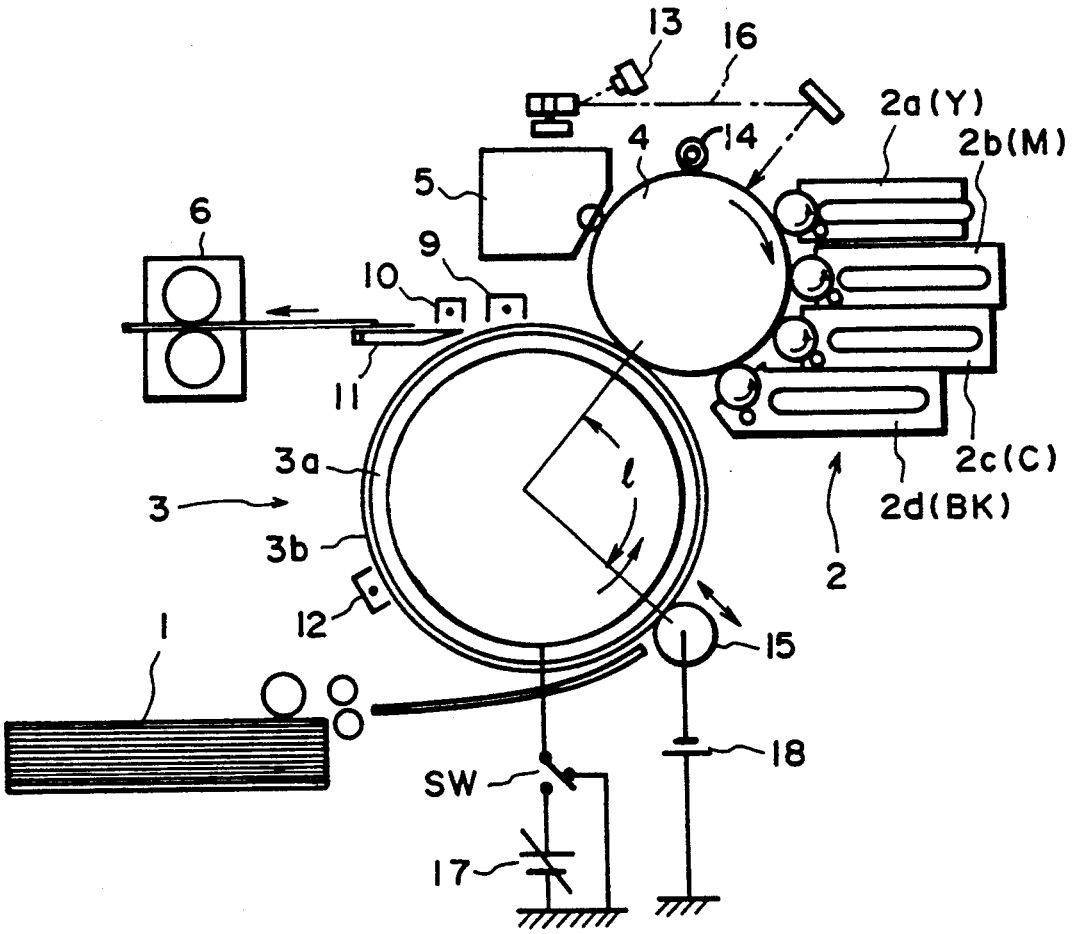
FIG. 4 is a sectional view of a color image forming apparatus according to a further embodiment of the present invention.

FIG. 4 shows a color image forming apparatus according to a third embodiment of the present invention. In this embodiment, unlike the foregoing embodiments, the transfer bias voltage source 17 rather than the attraction bias voltage source 18 is controllable in its output level gradually in accordance with output signal. More particularly, the output voltage thereof is changed to add to the transfer bias a surface potential difference ΔVa-b which is the difference between the surface potential Va of the portion A of the transfer material which is from the leading edge of the transfer material 1 to the length l which is the circumferential length on the transfer drum 3 from the attraction roller 15 to the image transfer position and a surface potential Vb in the portion B of the transfer material 1 which is from the leading edge of the transfer material to 2l. The addition of the voltage is effected when the portion B of the transfer material 1 enters the image transfer position by the rotation of the transfer drum 3.

In the image formation process of the color image forming apparatus of this embodiment, the transfer bias voltage for the first color changes during the transfer operation for the first color, and therefore, the surface potential difference ΔVa-b is changed in n steps during the same image transfer operation, when the length lp of the transfer material 1 is in the following relation with the distance l on the transfer drum 3:

$$lp \leqq n \times \text{distance } (l) \qquad (2)$$

$(n = 1, 2, 3, 4, \ldots)$

Unlike the foregoing embodiments, the transfer bias voltage in the second and subsequent transfer operations in this embodiment, the transfer bias voltage changes in n steps during the same transfer step, similarly to the first color transfer bias which changes in n steps.

By doing so, the surface potential of the transfer material 1 entering the image transfer position is maintained constant, and therefore, the improper image transfer attributable to the variation of the surface potential of the transfer material 1 can be avoided. FIG. 5 shows the change of the output voltages of the transfer and attraction bias voltage source 17 and 18 and the change of the surface potential of the transfer material immediately before the image transfer position in the case where n=2, in the image forming process of this embodiment.

Figure 5A:
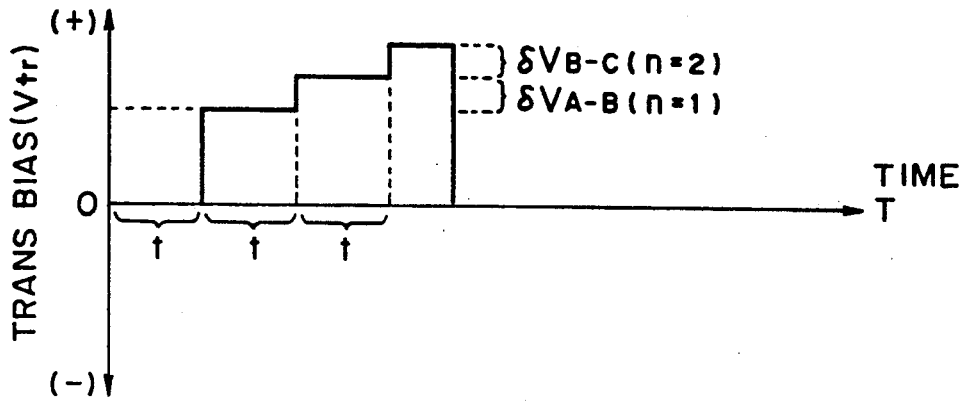
FIGS. 5A, 5B and 5C show an output of a transfer bias voltage source, an output of an attraction bias voltage source and a surface potential of a transfer material supplied to an image transfer position.
Figure 5B:
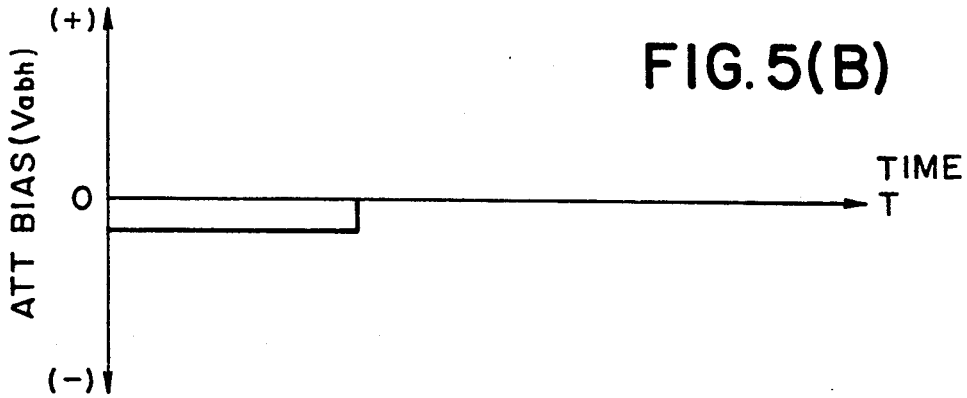
Figure 5C:
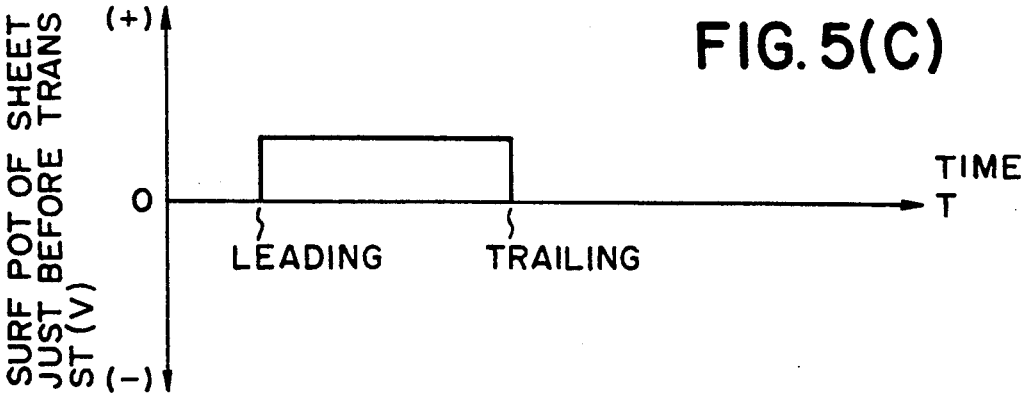
Figure 6:
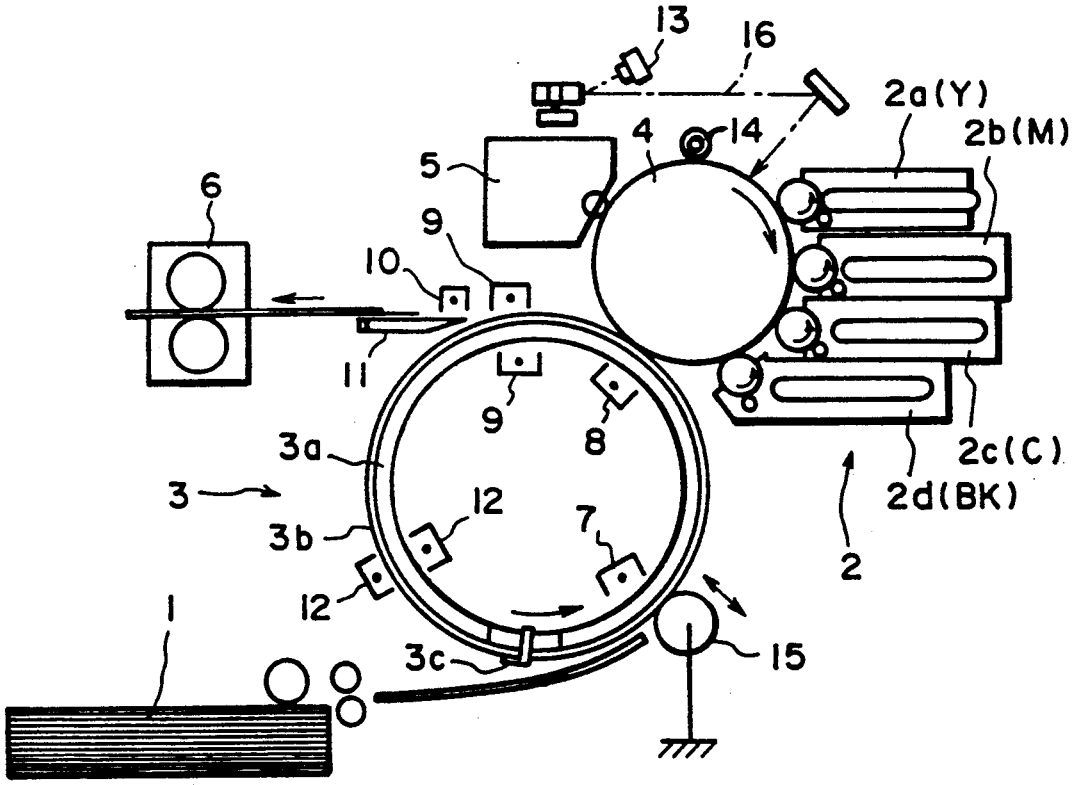
FIG. 6 is a sectional view of a color image forming apparatus.

In FIGS. 5(A) and (B), the timing of the various voltage is shown, and (C) shows the surface potential change of the transfer material immediately before the image transfer position. Here, ΔVb-c is a difference between a surface potential Vc of the portion C of the transfer material which is from the distance 2l position to the trailing edge of the transfer material and the surface potential Vb.

Figure 11:
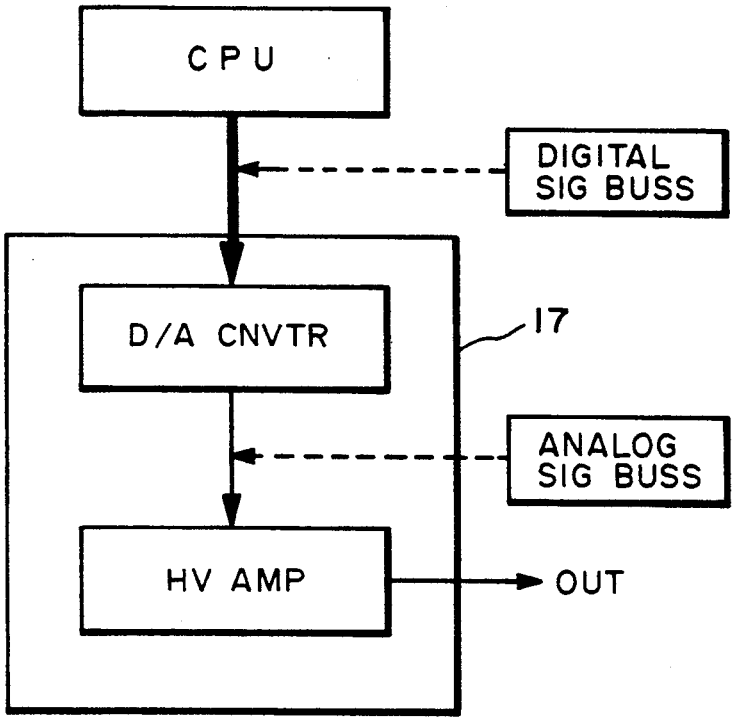
FIG. 11 is a block diagram of a transfer bias voltage source.

This embodiment, unlike the foregoing embodiments, requires that the transfer bias is changed in multi-stages. However, what are required are increases of the variable range of the transfer bias voltage source and increases of the number of timings, the transfer bias voltage source having already been such that its output level has been changed for the respective colors. When the transfer bias voltage source has the structure shown in FIG. 11, for example, it will suffice if only the control method for the output level of the transfer bias voltage source is properly changed. Since the output level control for the attraction bias voltage source is not required, the structure of the apparatus can be simplified.

In the foregoing embodiments, the attraction member 15 has been in the form of a roller movable toward and away from the transfer material carrying drum 3, but it may be in the form of a brush or an elastic plate.

The toner images transferred onto the transfer material are not limited to the combination of yellow, magenta, cyan toners, but is may be only two colors, black and red, for example.

As described in the foregoing, the superposed image forming apparatus according to this invention comprises a power source circuit capable of controlling transfer and attraction bias voltages so as to provide a constant surface potential of the transfer material on the transfer material carrying member. Therefore, the surface potential of the transfer material is maintained constant through out one color image transfer operation when any portion of the transfer material reaches the image transfer position, irrespective of whether the portion has been attracted only by the attraction bias voltage or the portion has been attracted by the attraction bias voltage and the transfer bias voltage. Therefore, the non-uniformity of the transfer efficiency which may arise when the transfer memory is avoided in the transfer material carrying member in the form of a solid drum. Therefore, a high quality of the superposed images can be provided. The present invention is more effective when full-color image is transferred.

While the invention has been described with reference to the structures disclosed herein, it is not confined to the details set forth and this application is intended to cover such modifications or changes as may come within the purposes of the improvements or the scope of the following claims.

What is claimed is:

1. A superposed image forming apparatus wherein toner images are superposedly transferred onto a transfer material, comprising:

an image bearing member;

means for forming a toner image on said image bearing member;

a transfer material carrying member, disposed opposed to said image bearing member, for carrying a transfer material in synchronism with the toner image on said image bearing member;

transfer material supplying means for supplying the transfer material to said transfer material carrying member;

a transfer bias voltage source for applying to said transfer material carrying member a bias voltage for image transfer from said image bearing member to the transfer material;

an attraction member for urging the transfer material to said transfer material carrying member to hold the transfer material on said transfer material carrying member;

an attraction bias voltage source for applying a bias voltage to said attraction member;

the bias voltage applied to the attraction member is changed in association with on-and-off of the bias voltage application to said transfer material carrying member so as to maintain a constant surface potential of said transfer material carrying member.

2. An apparatus according to claim 1, wherein said transfer material carrying member comprises a conductive base member and an electrostatic attraction surface layer.

3. An apparatus according to claim 2, wherein said apparatus is capable of forming a color image.

4. An apparatus according to claim 1, wherein said attraction member includes a conductive roller movable toward and away from said image bearing member.

5. A superposed image forming apparatus wherein different toner images are superposedly transferred onto a transfer material, comprising:

an image bearing member;

means for forming a toner image on said image bearing member;

a transfer material carrying member, disposed opposed to said image bearing member, for carrying a transfer material in synchronism with the toner image on said image bearing member;

transfer material supplying means for supplying the transfer material to said transfer material carrying member;

a transfer bias voltage source for applying to said transfer material carrying member a bias voltage for image transfer from said image bearing member to the transfer material;

an attraction member for urging the transfer material to said transfer material carrying member to hold the transfer material on said transfer material carrying member;

an attraction bias voltage source for applying a bias voltage to said attraction member;

wherein the voltage applied to said transfer material carrying member is changed in association with on-and-off of the voltage application to said attraction member so as to maintain a constant surface potential of said transfer material carrying member.

6. An apparatus according to claim 5, wherein said transfer material carrying member comprises a conductive base member and a electrostatic attraction surface layer.

7. A color image forming apparatus for forming a color image wherein different color toner images are superposedly transferred onto a transfer material, comprising:

an image bearing member;

means for forming a toner image on said image bearing member;

a transfer material carrying member, disposed opposed to said image bearing member, for carrying a transfer material in synchronism with the toner image on said image bearing member;

transfer material supplying means for supplying the transfer material to said transfer material carrying member;

a transfer bias voltage source for applying to said transfer material carrying member a bias voltage for image transfer from said image bearing member to the transfer material;

an attraction member for urging the transfer material to said transfer material carrying member to hold the transfer material on said transfer material carrying member;

an attraction bias voltage source for applying a bias voltage to said attraction member;

wherein said transfer material carrying member includes a conductive base member and an electrostatic attraction surface layer;

wherein a polarity of the voltage applied to said attraction member is changed to the same polarity as that of the voltage applied to said transfer material carrying member when the transfer bias voltage is applied to said transfer material carrying member so as to maintain substantially constant surface potential of said transfer material carrying member.

8. An apparatus according to claim 7, wherein said attraction member includes a conductive roller movable toward and away from said image bearing member.

9. An apparatus according to claim 7, wherein said same polarity voltage is provided by using said transfer bias voltage source as said attraction voltage source.

10. A color image forming apparatus for forming a color image wherein different color toner images are superposedly transferred onto a transfer material, comprising:

an image bearing member in the form of an electrophotographic photosensitive member;

means for forming a toner image on said image bearing member;

a transfer material carrying member, disposed opposed to said image bearing member, for carrying a transfer material in synchronism with the toner image on said image bearing member;

transfer material supplying means for supplying the transfer material to said transfer material carrying member;

a transfer bias voltage source for applying to said transfer material carrying member a bias voltage for image transfer from said image bearing member to the transfer material;

an attraction member for urging the transfer material to said transfer material carrying member to hold the transfer material on said transfer material carrying member;

an attraction bias voltage source for applying a bias voltage to said attraction member;

wherein said transfer material carrying member includes a conductive base member and an electrostatic attraction surface layer;

wherein the voltage to said attraction member is supplied from said attraction bias voltage source when the voltage is applied to said transfer material carrying member so as to maintain substantially constant surface potential of said transfer material carrying member.

11. An apparatus according to claim 5, wherein the transfer bias voltage is changed in accordance with a number of transfer operations.

12. An image forming apparatus, comprising:

an image bearing member;

means for forming a toner image on said image bearing member;

transfer material carrying means for carrying a transfer material thereon to transfer the toner image from said image bearing member on to the transfer material at a transfer position, said transfer material carrying means comprising a surface dielectric material layer and a conductive layer inside thereof;

a first voltage source for supplying electric power to the conductive layer;

electrostatic attraction means for electrostatically attracting the transfer material onto said transfer material carrying means;

a second voltage source for supplying electric power to said attraction means;

wherein a potential difference between said conductive layer and said attraction means during an attracting operation is constant irrespective of operation or non-operation of said first voltage source.

13. An apparatus according to claim 12, wherein a potential difference between an output potential of said first voltage source and an output potential of said second voltage source is constant irrespective of operation or non-operation of said first voltage source.

14. An apparatus according to claim 12, wherein said second voltage source is connected between said conductive layer and said attraction means, and said first voltage source is connectable to between a ground level and a level between levels of said second voltage source and said conductive layer.

15. An apparatus according to claim 14, wherein said first voltage source is switched from a non-operative state to an operative state when a leading edge of the transfer material carried on said transfer material carrying means reaches a transfer station.

16. An apparatus according to claim 12, wherein an output of said second voltage source is changed when said first voltage source is switched from a non-operative state to an operative state.

17. An apparatus according to claim 16, wherein said first voltage source is switched from the non-operative state to the operative state when a leading edge of the transfer material carried on said transfer material carrying means reaches a transfer station.

18. An apparatus according to claim 12, wherein the output of said first voltage source is changed when a time period from attraction of a leading edge of the transfer material on said transfer material carrying means by said attraction means to a switching of the first voltage source from a non-operative state to an operative state, elapses after arrival of the leading edge at the transfer position.

19. An apparatus according to claim 18, wherein said first voltage source is switched from the non-operative state to the operative state when a leading edge of the transfer material carried on said transfer material carrying means reaches a transfer station.

20. An apparatus according to claim 12, wherein the output of said first voltage source and that of said second voltage source have opposite polarities.

21. An apparatus according to claim 12, wherein plural color toner images are formed on said image bearing member, and the toner images are superposedly transferred onto the transfer material one by one.

22. An apparatus according to claim 21, wherein a full color image is formed on the transfer material.

23. An apparatus according to claim 15, 17, or 19, wherein said first voltage source is switched from the operative state to the non-operative state when a trailing edge of the transfer material carried on said transfer material carrying means reaches the transfer position.

24. An apparatus according to claim 15, 17 or 19, wherein said image forming means has charging means for charging said image bearing member, and a charging polarity of said charging means and a polarity of an output of said first voltage source are opposite to each other.

25. An apparatus according to claim 12, wherein said attraction means is contactable to the dielectric layer.

26. An image forming apparatus comprising:

an image bearing member;

means for forming a toner image on said image bearing member;

transfer material carrying means for carrying a transfer material thereon to transfer the toner image from said image bearing member onto the transfer material at a transfer position, said transfer material carrying means comprising a surface dielectric material layer and a conductive layer inside thereof;

a first voltage source for supplying electric power to the conductive layer;

electrostatic attraction means for electrostatically attracting the transfer material onto said transfer material carrying means; and a second voltage source for supplying electric power to said attraction means;

wherein an output of said second voltage source is switched on and off during attracting operation in synchronism with a switching on and off of an output of said first voltage source.

27. An apparatus according to claim 26, wherein the output of said second voltage source is changed in synchronism with switching of said first voltage source from a non-operative state to an operative state.

28. An apparatus according to claim 27, wherein said first voltage source is switched from the non-operative state to the operative state when a leading edge of the transfer material carried on said transfer material carrying means reaches a transfer station.

29. An apparatus according to claim 26, wherein an output of said first voltage source and an output of said second voltage source are of opposite polarities.

30. An apparatus according to claim 26, wherein plural color toner images are formed on said image bearing member, and the toner images are superposedly transferred onto the transfer material one by one.

31. An apparatus according to claim 30, wherein a full color image is formed on the transfer material.

32. An apparatus according to claim 28, wherein said first voltage source is switched from the operative state to the non-operative state when a trailing edge of the transfer material carried on said transfer material carrying means reaches the transfer position.

33. An apparatus according to claim 28 or 32, wherein said image forming means has charging means for charging said image bearing member, said charging means having a polarity opposite to that of said first voltage source.

34. An apparatus according to claim 26, wherein said attraction means is contactable to the dielectric layer.

35. An image bearing member comprising;

means for forming a toner image on said image bearing member;

transfer material carrying means for carrying a transfer material thereon to transfer the toner image from said image bearing member to the transfer material at a transfer position, said transfer material carrying means comprising a surface dielectric material layer and a conductive layer inside thereof;

a first voltage source for supplying electric power to the conductive layer;

electrostatic attraction means for electrostatically attracting the transfer material onto said transfer material carrying means; and a second voltage source for supplying electric power to said attraction means;

wherein the output of said first voltage source is changed when a time period from attraction of a leading edge of the transfer material on said transfer material carrying means by said attraction means to switching of the first voltage source from a non-operative state to an operative state, elapses after arrival of the leading edge at the transfer position.

36. An apparatus according to claim 35, wherein said first voltage source is switched from the non-operative state to the operative state when a leading edge of the transfer material carried on said transfer material carrying means reaches the transfer position.

37. An apparatus according to claim 35, wherein an output of said first voltage source and an output of said second voltage source are opposite from each other.

38. An apparatus according to claim 35, wherein plural color toner images are formed on said image bearing member, and the toner images are superposedly transferred onto the transfer material one by one.

39. An apparatus according to claim 38, wherein a full color image is formed on the transfer material.

40. An apparatus according to claim 36, wherein said first voltage source is switched from the operative state to the non-operative state when a trailing edge of the transfer material carried on said transfer material carrying means reaches the transfer position.

41. An apparatus according to claim 36 or 40, wherein said image forming means has charging means for charging said image bearing member, said charging means having a polarity opposite to an output of said first voltage source.

42. An apparatus according to claim 35, wherein said attraction means is contactable to the dielectric layer.

* * * * *

UNITED STATES PATENT AND TRADEMARK OFFICE

CERTIFICATE OF CORRECTION

PATENT NO. : 5,287,163
DATED : February 15, 1994
INVENTOR(S) : TOSHIAKI MIYASHIRO, ET AL.

It is certified that error appears in the above-indentified patent and that said Letters Patent is hereby corrected as shown below:

Column 4,
Line 39, "several K" should read --several KV--; and
Line 46, "tens" should read --tends--.

Column 5,
Line 48, "different" should read --difference--.

Column 7,
Line 66, "in a" should be deleted.

Column 8,
Line 9, "FIG-" should read --FIG.--;
Line 10, "URE," should be deleted; and
Line 58, "is" should be deleted.

Signed and Sealed this

Twenty-third Day of August, 1994

Bruce Lehman

*Attest:*

BRUCE LEHMAN

*Attesting Officer*

*Commissioner of Patents and Trademarks*